US006098362A

United States Patent [19]

Marriott et al.

[11] Patent Number: 6,098,362

[45] Date of Patent: Aug. 8, 2000

[54] PLASTIC TILE AND TROUGH ASSEMBLY FOR USE ON WOODEN DECKS

[76] Inventors: Cameron Frank Marriott, Box 3854, Olds, Alberta, Canada, T4H 1P5; Kent Gray Jensen, 227 Piper Drive, Red Deer, Alberta, Canada, T4P 1L5

[21] Appl. No.: 09/004,586

[22] Filed: Jan. 8, 1998

[51] Int. Cl.[7] ..... E04F 17/00

[52] U.S. Cl. ..... 52/302.3; 52/3; 52/459; 52/506.05; 52/533

[58] Field of Search ..... 52/3, 263, 459, 52/461, 465, 468, 650.3, 302.3, 410, 506.05, 548, 177, 533, 521, 526, 525, 748.1

[56] References Cited

U.S. PATENT DOCUMENTS

| | | | |
|---|---|---|---|
| 4,065,883 | 1/1978 | Thibodeau | 52/11 |
| 4,167,599 | 9/1979 | Nissinen | 52/177 |
| 4,930,286 | 6/1990 | Kotler | 52/177 |
| 4,947,595 | 8/1990 | Douds et al. | 52/177 |
| 5,412,915 | 5/1995 | Johnson | 52/177 |
| 5,511,351 | 4/1996 | Moore | 52/302.1 |
| 5,616,389 | 4/1997 | Blatz | 428/45 |
| 5,787,654 | 8/1998 | Drost | 52/302.3 |

*Primary Examiner*—Carl D. Friedman
*Assistant Examiner*—Dennis L. Dorsey
*Attorney, Agent, or Firm*—Holme Roberts & Owen LLP

[57] ABSTRACT

Plastic tiles are combined with troughs to cover a wooden deck. The U-shaped troughs are laid across the deck in parallel and are slightly spaced apart to form gaps between them. Each tile comprises a rectangular upper block having downwardly depending legs. The block stands on two adjacent troughs and bridges the gap. Rainwater moves through the cracks between the tiles and is received in the troughs, which form sluice-ways for conveying it to the edge of the deck for release. The block has a forwardly projecting, narrow protrusion positioned to register with the gap. The protrusion forms a laterally extending channel, for conveying water across the gap to the troughs, and a hole through which a screw may be driven to affix the tile to the wood of the deck at the gap. The protrusion fits beneath the rear end of the next tile so that the screw is isolated from the water. The assembly of tiles and troughs prevents water reaching the wood of the deck.

8 Claims, 5 Drawing Sheets

PLASTIC TILE AND TROUGH ASSEMBLY FOR USE ON WOODEN DECKS

FIELD OF THE INVENTION

The invention relates to a plastic tile for use with a wooden deck. It also relates to the combination of the tiles with underlying troughs for surfacing the deck. The assembly of tiles and troughs is designed to provide a deck surface which prevents rainwater reaching the wood.

BACKGROUND OF THE INVENTION

In recent years, extruded hollow plastic planks have been developed for use in connection with decks. The planks are commonly nailed or screwed to underlying wooden joists or the plywood sheeting of a deck. Since the plastic planks are impervious to moisture, they do not rot like wooden planks will over time.

However, plastic expands and contracts more than wood does with variations in temperature. In winter it is not unusual for the plastic to split where a nail or screw fastener has been driven through it. Furthermore, moisture can leak down along the fastener and still penetrate the supporting wood structure.

The present invention addresses these problems in the context of providing plastic tiles to overlie a supporting wooden sub-structure (referred to hereinafter as the "wooden deck").

SUMMARY OF THE INVENTION

A water-impermeable tile is provided for application on sloped wooden decks. The tile is designed to be used in combination with underlying water-impermeable sluice-ways. Preferably the sluice-ways are U-shaped troughs. The rainwater runs down the tile, drops through the cracks or spaces between the tile and its neighbors, and is delivered into the underlying troughs. The troughs convey the water to the edge of the deck, where it is released.

The tile comprises:

- a preferably rectangular block having a plurality of laterally spaced, downwardly extending legs or ribs for spacing the block above the underlying troughs so that the water may pass beneath it;
- the block has at least one protrusion extending forwardly from its peripheral front edge. The protrusion is narrow, relative to the block, for a reason which will be explained. Its top surface is recessed relative to the top surface of the block (the protrusion is preferably about one half the height of the tile). The tiles are designed so that the protrusion of one tile can slide snugly under the next tile. Immediately adjacent the edge of the block, the protrusion preferably forms a laterally extending channel. Water falling over the front edge of the block in the region of the protrusion drops into this channel and is conveyed laterally for release into the underlying troughs. The protrusion further provides a structure, forward of the channel, through which a screw or nail fastener may be driven to affix the tile to the wooden deck. When the protrusion is hidden beneath the next tile, water is kept from reaching the fastener; and
- the peripheral side and front and rear edges of the block are provided with tenon and mortice means (such as tongue and groove on the sides and lap joint elements at the ends) for forming joints and interlocking adjacent tiles to resist warping and to provide gapping to allow some thermal expansion without the tiles butting up against each other and buckling.

As previously stated, the tiles are used in conjunction with underlying water-impervious sluice-ways, preferably troughs. More particularly:

- the trough may comprise an elongated rectangular flat strip of plastic or sheet metal having upturned side edges;
- the troughs are positioned across the deck in side-by-side, narrowly spaced apart arrangement so that slots, open to the wood, are formed between them. The tiles are positioned so that their protrusions register with the slots. Thus the fasteners can be driven directly into the wood, without piercing the troughs.

The foregoing describes the preferred best mode of the invention as presently embodied. It is characterized by the following advantages:

- the tile is relatively short in comparison to the prior art plastic planks—thus the heat expansion problem is less severe with the tile;
- the tile is aesthetically improved because fasteners are hidden;
- the assembly of the tiles and troughs is designed to prevent water reaching the wood or the fastener; and
- the tiles are designed to permit some thermal expansion without having a tile butting into its neighbors.

Broadly stated, the invention involves a tile for covering a wooden deck comprising: a water impermeable block having top and bottom surfaces and peripheral side, front and back edges; said block having a plurality of laterally distributed, downwardly projecting legs extending from its bottom surface for spacing the block above the deck; the block rear edge protruding rearwardly beyond the legs to form a laterally extending, covered, downwardly and rearwardly opening space; said block having a protrusion, preferably relatively narrow relative to the block itself, extending forwardly from its front edge, said protrusion having a top surface recessed below the block's top surface, said protrusion top surface preferably forming a laterally extending channel immediately adjacent the block's front edge so that water dropping over the edge in the region of the protrusion will be conveyed laterally a short distance and then released, said protrusion providing a structure, forward of the channel, for receiving a nail or screw fastener to affix the tile to the deck; the protrusion being recessed sufficiently so that it may extend beneath the next forwardly adjacent similar tile so that the fastener will be shielded from rain.

DESCRIPTION OF THE PREFERRED EMBODIMENT

Figure 1:
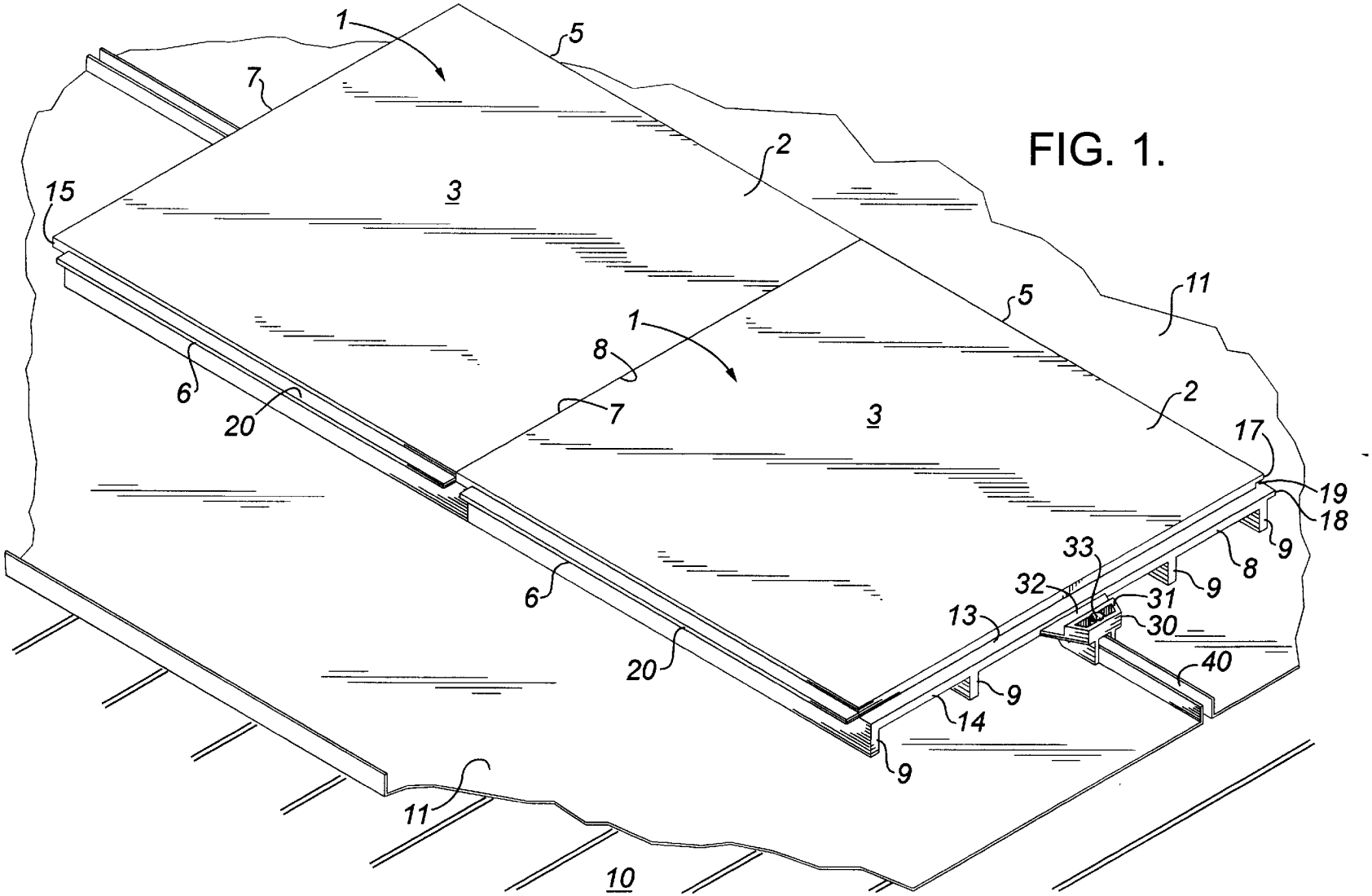
FIG. 1 is a perspective view of two joined tiles and troughs, viewed from above.
Figure 2:
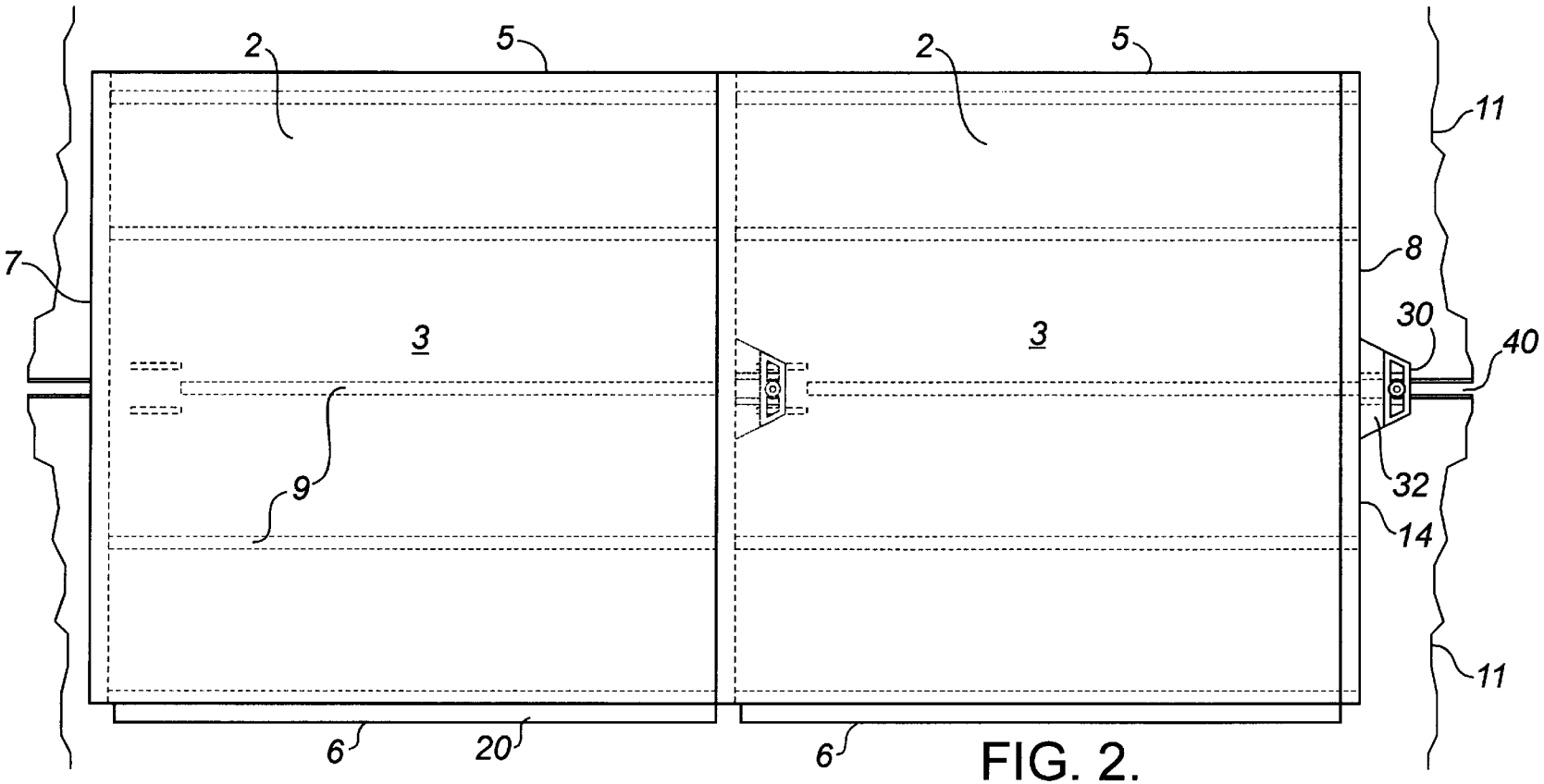
FIG. 2 is a plan view of the assembly of FIG. 1.
Figure 3:
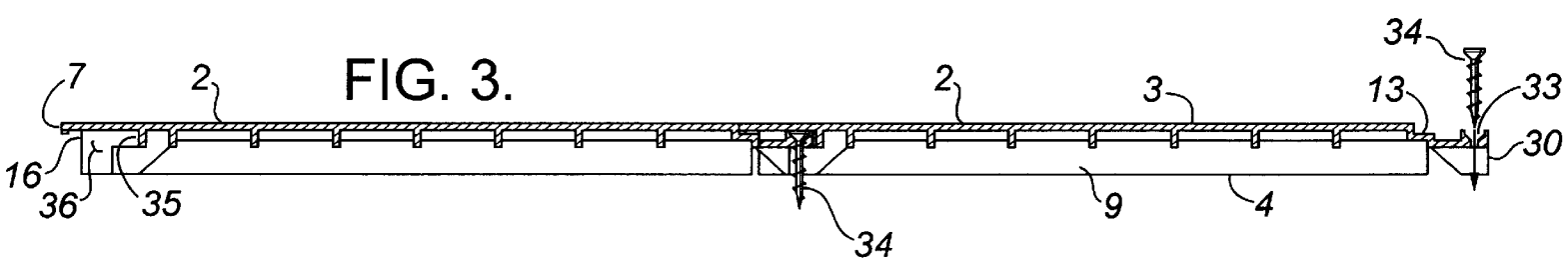
FIG. 3 is a sectional longitudinal view showing the assembly of FIG. 1.
Figure 4:
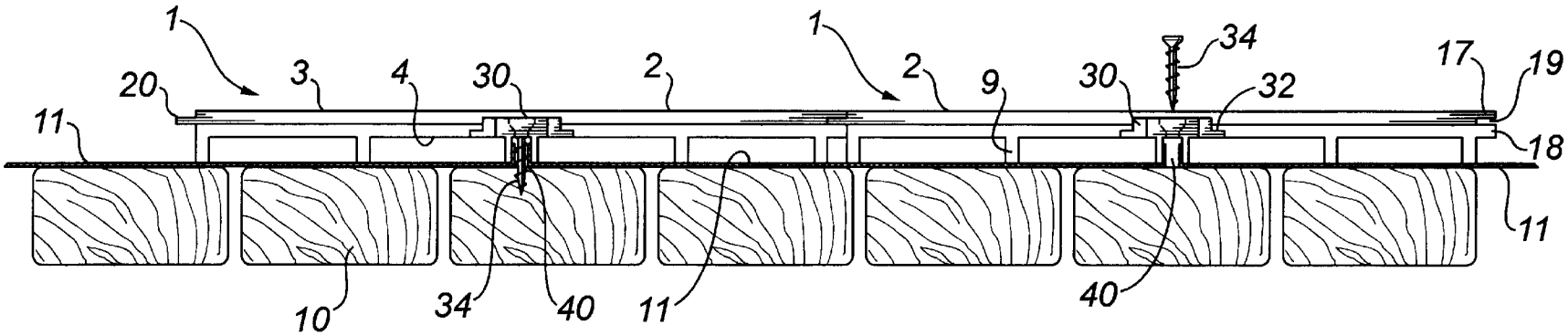
FIG. 4 is a sectional transverse view showing the assembly of FIG. 1.
Figure 5:
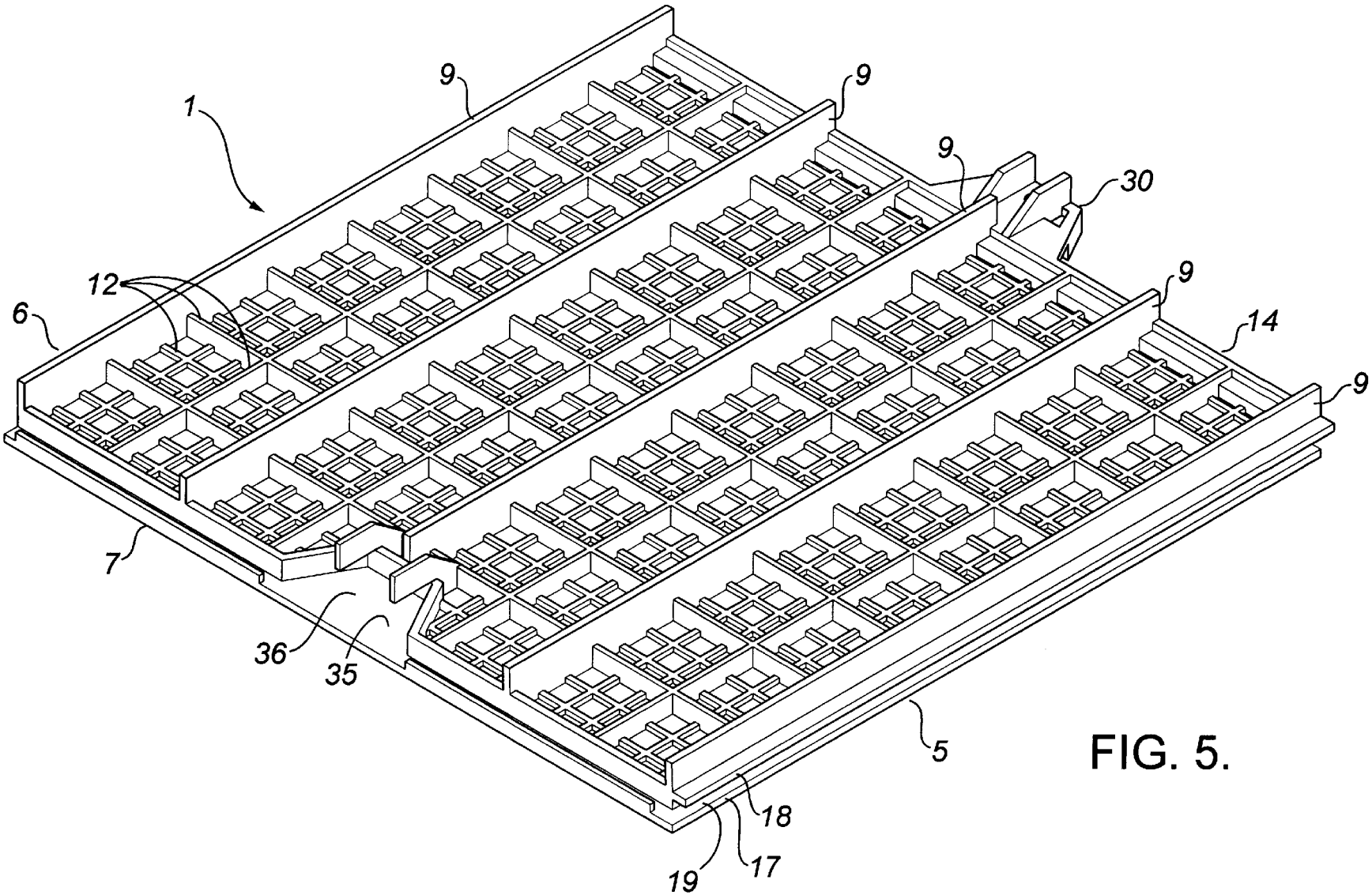
FIG. 5 is a perspective view of the underside of a tile.

Having reference to FIGS. 1–5, the tile 1 comprises a rectangular block 2 having top and bottom surfaces 3, 4 and peripheral side, back and front edges 5, 6, 7 and 8. A plurality of laterally spaced ribs or legs 9 extend downwardly from the underside surface 4 for spacing the block 2 above the deck 10 and troughs 11 on which it stands. A pattern of ribs 12 is integral with the block 2 on its underside and functions to strengthen and rigidify the tile.

The block's front edge 8 forms an upwardly opening groove 13 and shoulder 14. The back edge 7 forms a shoulder 15 which protrudes beyond the rear ends of legs 9 to define a laterally extending and downwardly opening covered space 16. When the front edge 8 of one tile engages the rear edge 7 of an adjacent tile, the groove 13, space 16 and shoulders 14, 15 form a lap joint. One side edge 5 of the block 2 forms a pair of spaced apart ribs 17, 18 defining a side opening groove 19. The other side edge 6 forms an outwardly projecting rib 20. When the side edge 6 of one tile engages the side edge 5 of another tile, the ribs 17, 18, 20 and groove 19 form a tongue and groove joint.

A protrusion 30 projects forwardly from the block's front edge 8. The top surface 31 of the protrusion is recessed so that the protrusion may slide under the rear of the next tile ahead. The protrusion 30 forms a laterally extending channel 32 for conveying water dropping through the crack between tiles and delivering it to the troughs 11. The protrusion 30 also forms a hole 33 through which a screw 34 extends to affix the tile 1 to the deck 10.

The bottom surface 35 of the rear end of the block 2 forms a central walled recess 36 for receiving the protrusion 30.

The protrusion 30 is preferably narrow relative to the width of the block 2. We have found that if the protrusion 30 is too wide, the water in the channel 32 may overflow and reach the screw 34.

As shown in FIG. 1, the troughs 11 are spaced apart to define a slot 40 open to the deck 10. The tile 1 is positioned centrally over the slot 40 so that the protrusion 30 registers with it. Thus the screw 34 can be driven into the wood. The laterally extending channel 32 catches water entering through the crack between tiles and conveys it across the slot 35 for delivery into the adjacent troughs 11.

Figure 6:
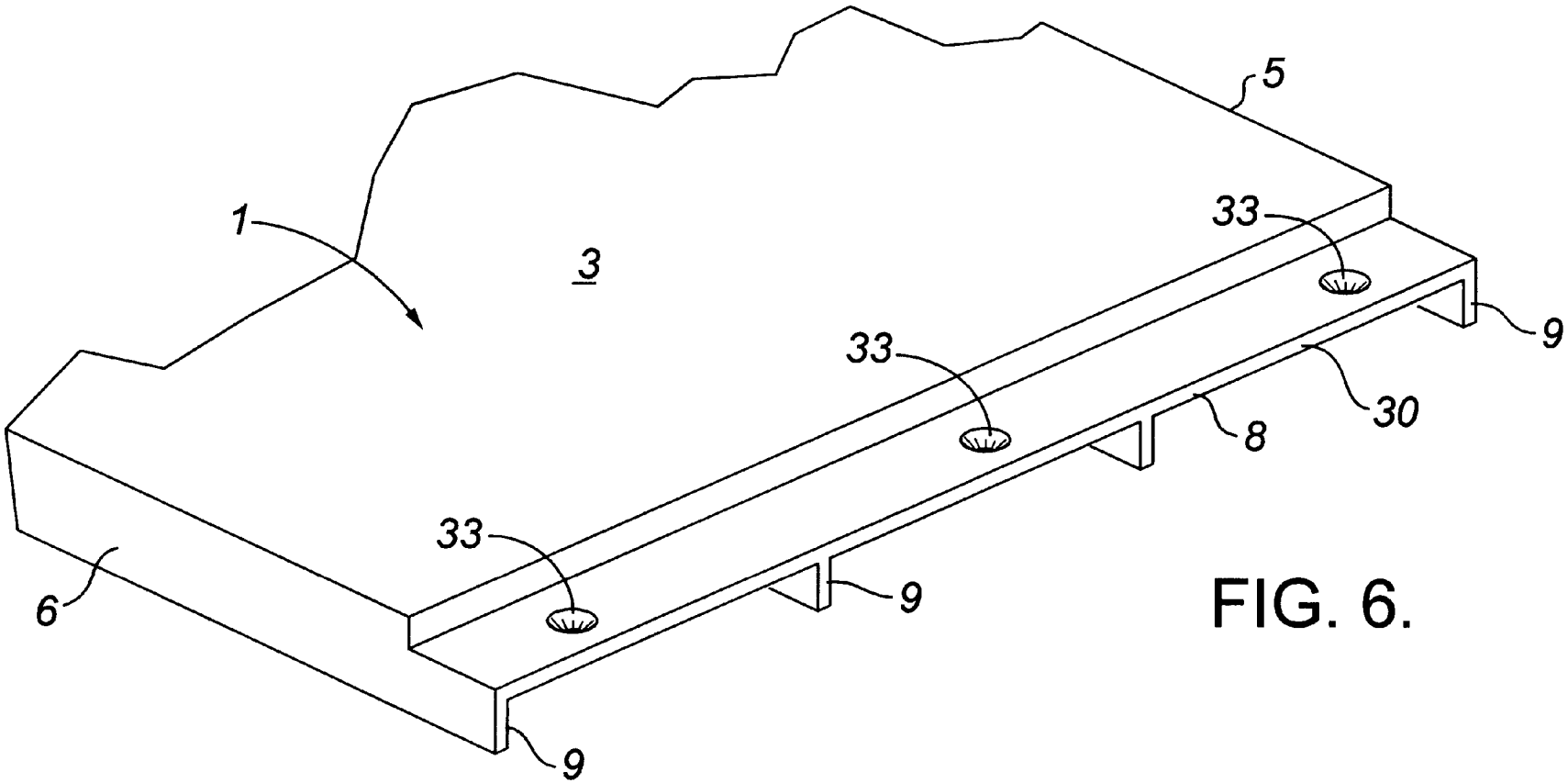
FIG. 6 is a perspective view of an alternative version of the tile.

An alternative form of the tile 1 is shown in FIG. 6. In this embodiment, the recessed protrusion 30 extends the full width of the tile. This version of the tile can be used with a single wide sluice-way. In this assembly the lateral channel is not required.

The tile 1 is preferably formed of high density polyethylene. The trough 11 can be formed of plastic or sheet metal.

The scope of the invention is defined in the claims now following.

The embodiments of the invention in which an exclusive property or privilege is claimed are defined as follows:

1. A tile for covering a wooden deck comprising:

a water impermeable block having top and bottom surfaces and peripheral side, front and rear edges;

said block having a plurality of laterally distributed, downwardly projecting legs extending from its bottom surface for spacing the block above the deck;

the block rear edge protruding rearwardly beyond the legs to form a laterally extending, covered, downwardly and rearwardly opening space;

said block having a relatively narrow protrusion extending forwardly from its front edge, said protrusion having a top surface recessed below the block's top surface, said protrusion top surface forming a laterally extending channel immediately adjacent the block's front edge so that water dropping over the edge will be conveyed laterally a short distance and then released, said protrusion providing a structure, forward of the channel, for receiving a nail or screw fastener to affix the tile to the deck.

2. The tile as set forth in claim 1 wherein:

the side edges of the block each have tenon and mortice means for forming a joint with the block edge of an adjacent similar tile.

3. The tile as set forth in claim 1 wherein the tile is rectangular and formed of plastic.

4. A tile and trough assembly for use in covering a wooden deck, comprising:

a pair of troughs to be set on the deck in side by side, spaced apart relationship to form a narrow slot between them which is open to the wood, each trough comprising a flat, rectangular, water-impermeable wall having upturned side edges, each trough forming a sluice-way for water;

a plurality of tiles to be set in line on the troughs so that they are positioned over the slot;

each tile comprising a water-impermeable, rectangular block having top and bottom surfaces and peripheral side, front and back edges said block having a plurality of laterally distributed, downwardly projecting legs extending from its bottom surface for spacing the block above the troughs, the block rear edge protruding rearwardly beyond the legs to form a laterally extending, covered, downwardly and rearwardly opening space, said block having a relatively narrow protrusion extending forwardly from its front edge, said protrusion being adapted to register with the slot and to contact the underlying wood, said protrusion having a top surface recessed below the block's top surface, said protrusion top surface forming a laterally extending channel immediately adjacent the block's front edge so that water dropping over the edge in the region of the protrusion will be conveyed laterally and released into the underlying troughs, said protrusion forming a structure, forward of the channel, for receiving a nail or screw fastener to affix the tile to the deck at the slot, the protrusion being recessed sufficiently so that it may extend into the covered space of the next forwardly adjacent similar tile so that the fastener will be shielded from rain.

5. The assembly as set forth in claim 4 wherein:

the side edges of the block each have tenon and mortice means for forming a joint with the block edge of an adjacent tile.

6. The assembly as set forth in claim 4 wherein the tile is rectangular and formed of plastic.

7. The tile as set forth in claim 2 wherein the tile is rectangular and formed of plastic.

8. The assembly as set forth in claim 5 wherein the tile is rectangular and formed of plastic.

* * * * *